United States Patent [19]

Larson

[11] Patent Number: 5,060,328

[45] Date of Patent: Oct. 29, 1991

[54] WATERBED MATTRESS WITH SPRING INSERT

[76] Inventor: Lynn D. Larson, 1052 N. Lakeshore Dr., Lincoln, Nebr. 68528

[21] Appl. No.: 594,416

[22] Filed: Oct. 9, 1990

[51] Int. Cl.[5] ..... A47C 27/08

[52] U.S. Cl. ..... 5/450; 5/451; 297/DIG. 8

[58] Field of Search ..... 5/451, 450, 455, 422, 5/452, 464; 297/DIG. 8, DIG. 3

[56] References Cited

U.S. PATENT DOCUMENTS

| | | | |
|---|---|---|---|
| 3,261,037 | 7/1966 | Cermak et al. | 297/DIG. 8 |
| 3,280,410 | 10/1966 | Probst et al. | 297/DIG. 8 |
| 4,109,333 | 8/1978 | Zmiapovich | 5/451 |
| 4,120,061 | 10/1978 | Clark | 297/DIG. 8 |
| 4,218,274 | 8/1980 | Mollura | 156/65 |
| 4,245,362 | 1/1981 | Mueller | 5/451 |
| 4,245,363 | 1/1981 | Callaway | 5/451 |
| 4,292,701 | 10/1981 | Woychick | 5/422 |
| 4,328,599 | 5/1982 | Mollura | 5/451 |
| 4,475,257 | 10/1984 | Phillips | 5/450 |
| 4,551,873 | 11/1985 | Hall | 5/450 |
| 4,574,026 | 3/1986 | Winther | 156/274.4 |
| 4,663,789 | 5/1987 | Smith | 5/450 |
| 4,701,967 | 10/1987 | Strobel | 5/450 |
| 4,707,872 | 11/1987 | Hessel | 5/451 |
| 4,715,076 | 12/1987 | Fogel et al. | 5/450 |
| 4,750,959 | 6/1988 | Johenning et al. | 156/145 |
| 4,864,670 | 9/1989 | Woll et al. | 5/450 |
| 4,922,563 | 5/1990 | Johenning et al. | 5/450 |

*Primary Examiner*—Alexander Grosz

*Attorney, Agent, or Firm*—Law Offices of John A. Beehner

[57] ABSTRACT

A waterbed mattress includes a spring insert comprising a plurality of spring bellows units arranged in upright relation within the mattress. Each bellows unit has a top wall and pleated sidewall which is collapsible from a normal expanded height to a shortened compressed height wherein the internal volume of the bellows unit is substantially reduced. Each bellows unit furthermore has a bleeder opening through one wall so that a compression load exerted on the bellows unit through the mattress top wall is resisted by both spring action and hydraulic action of the bellows units. The bellows units may be confined within flexible covers defining secondary hydraulic chambers. The size, position and hydraulic characteristics may be varied for different degrees of support at different positions on the mattress.

33 Claims, 5 Drawing Sheets

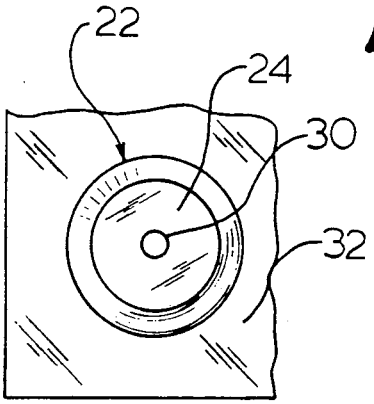
FIG.6
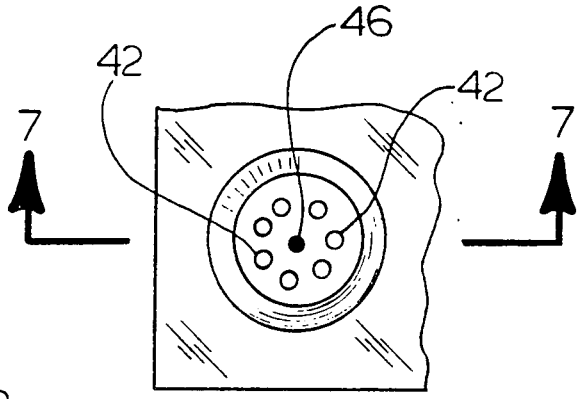
FIG.8
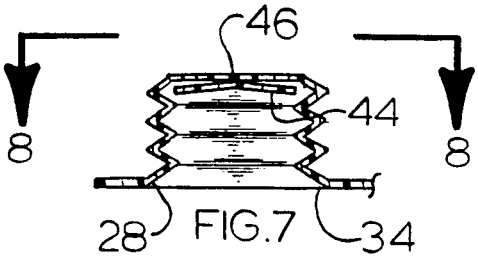
FIG.7
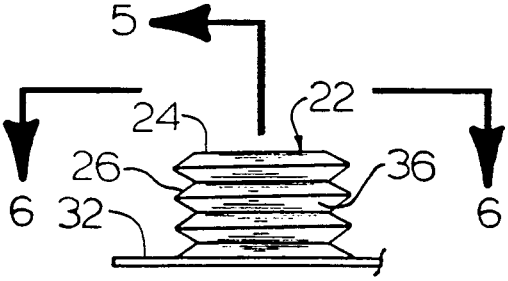
FIG.4
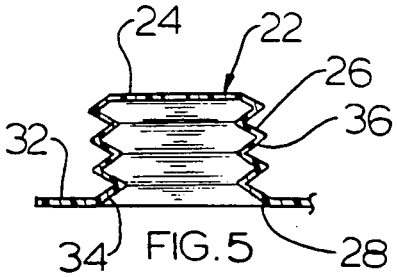
FIG.5
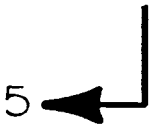
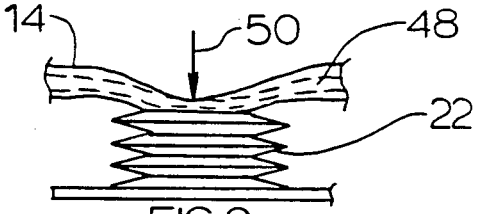
FIG.9
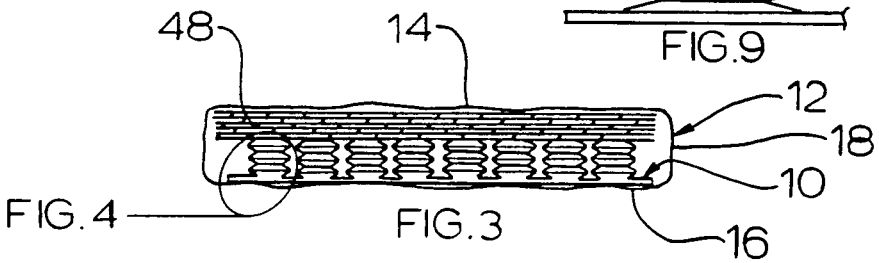
FIG.4
FIG.3
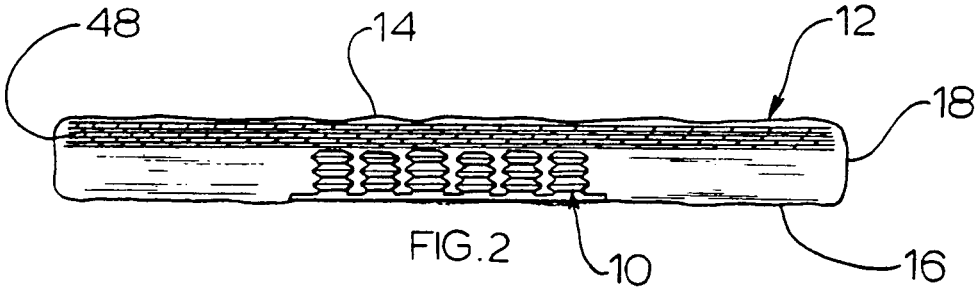
FIG.2

WATERBED MATTRESS WITH SPRING INSERT

BACKGROUND OF THE INVENTION

The present invention is directed generally to a waterbed mattress including a spring insert for auxiliary support for loads placed on the mattress above the insert.

Improved sleep is experienced on a waterbed mattress, compared to sleep on a conventional mattress, because the support forces are more uniformly distributed across the body thereby substantially eliminating localized pressure points. This same characteristic, however, makes the top surface of a waterbed mattress more susceptible to deflection by a concentrated load such as when one sits or kneels on a waterbed mattress. Internal baffling systems and foam and fiber fillers have been incorporated into waterbed mattresses to eliminate wave action and restrict the flow therein. These, however, have only indirectly improved the resistance of a waterbed mattress surface to deflection by a concentrated load.

Previous attempts have been made to incorporate springs within a waterbed mattress. Callaway U.S. Pat. No. 4,245,363, for example, provides coil springs within an annular chamber surrounding a central waterbed mattress bladder to support one seated on the edge of a waterbed mattress. An alternate embodiment shows coil springs within the waterbed mattress bladder as well. Such a mattress, however, requires structure for supporting the individual coils and for preventing puncture of the mattress walls, all of which increase the expense of the mattress. The complexity inherently presents manufacturing problems and an increased number of potential failure points on the mattress.

Accordingly, a primary object of the invention is to provide an improved spring insert for a waterbed mattress.

Another object is to provide such an insert which includes a plurality of spring bellows units.

Another object is to provide such a spring insert which does not require mechanical attachment to the waterbed mattress.

Another object is to provide such a spring insert which combines mechanical spring resistance with flow resisting chambers to effect shock absorption as well as spring resistance to concentrated loads on a waterbed mattress.

Another object is to provide a spring insert in which a plurality of spring units are arranged and supported relative to one another.

Another object is to provide such a spring insert which is free of attachment to the bottom wall of the mattress but which functions substantially as if it were so attached.

Another object is to provide such a spring insert wherein the spring bellows units are arranged in a nonuniform distribution to impart different support for different areas of the mattress top wall.

Another object is to provide such an insert wherein the spring bellows units have different force/deflection characteristics to likewise vary the degree of support at different positions on the waterbed mattress.

Another object is to provide such a spring insert wherein certain spring bellows units have different heights and cross sectional areas to further vary the degree of support by the different bellows units.

Another object is to provide such a spring insert wherein the bellows units are provided with valved bleeder openings.

Another object is to provide such a spring insert wherein the bellows units are enclosed within flexible covers defining secondary hydraulic chambers between the bellows units and respective covers.

Another object is to provide such a spring insert wherein joint hydraulic chambers are formed by stacked pairs of upper and lower bellows units.

Another object is to provide such a spring insert with a valve for adjusting fluid communication between stacked pairs of upper and lower bellows units.

Another object is to provide such a spring insert with channels between adjacent spring bellows units for limited fluid communication between them.

Another object is to provide an improved waterbed mattress including the spring insert of the invention.

Another object is to provide such an improved waterbed mattress and spring insert which are simple and rugged in construction, economical to manufacture and efficient in operation.

SUMMARY OF THE INVENTION

The spring insert of the present invention is adapted to be enclosed within the fluid-tight water containing bladder of a waterbed mattress. The insert includes a plurality of open bottomed cup-shaped spring bellows units. Each bellows unit has a top wall and pleated sidewall so as to be collapsible from a normal expanded height to a shortened compressed height wherein the internal volume of the unit is substantially reduced. Each bellows unit further includes a bottom opening and a small bleeder opening in one wall thereof.

To support the bellows relative to one another and in upright relation within the mattress chamber, a panel is provided with a plurality of spaced apart openings, each adapted for registration with a bellows unit. In a preferred embodiment, the bellows units are integrally formed with the panel such that the bottom edge of each bellows is an integral extension of the bottom panel.

The spring inserts may cover substantially the entire bottom surface of the mattress or preferably only a central longitudinal region most susceptible to supporting the weight of a person seated on the mattress. Furthermore, the spring bellows units may be arranged in non-uniform distribution over the mattress bottom wall to impart different support for different areas of the mattress top wall. This can accommodate different degrees of support for different body parts of a single sleeper and different support characteristics for two sleepers on different sides of the mattress. A fiber layer may be installed above the spring bellows units for mechanical insulation. Furthermore, the bellows units may be modified to provide one way valving of the bleeder opening for firmer hydraulic action.

The degree of support provided by selected spring baffle units can be altered by varying any one or more of the following characteristics for individual spring baffle units: normal expanded height, width, spring rate, number and size of bleeder openings and the extent of communication between spring bellows units.

Downward force exerted on a bellows unit through the mattress top wall tends to collapse the unit against the spring action of the pleated sidewall construction. That same force tends to seal the mattress against the mattress bottom wall so that fluid flow from the unit is generally constrained to flow through the bleeder opening. Accordingly, each spring bellows unit functions as a shock absorber as well as a spring for firm and comfortable support even when subjected to a concentrated load.

In certain embodiments, the spring bellows units may preferably be formed by stacking and connecting upper and lower spring sections. This provides numerous opportunities for adjustment. Spring rate of the upper and lower bellows units may be different. Bleeder openings may be provided in only one of them. Communication between adjacent bellows units may be provided in either the upper or lower spring section or they may jointly define channels between adjacent hydraulic chambers. Furthermore, a valve plate may be interposed between the upper and lower spring sections to adjust fluid communication between them and, therefore, their hydraulic characteristics.

BRIEF DESCRIPTION OF THE DRAWINGS

FIG. 2 is a side sectional view of the waterbed mattress taken along line 2—2 in FIG. 1;

FIG. 3 is an end sectional view of the waterbed mattress as taken along line 3—3 in FIG. 1;

FIG. 4 is an enlarged detail elevational view of the spring bellows unit of the invention;

FIG. 5 is a side sectional view of the spring bellows unit taken along lines 5—5 in FIG. 4;

FIG. 6 is a top plan view of the spring bellows unit as seen along line 6—6 in FIG. 4;

FIG. 7 is a side sectional view of an alternate embodiment of a spring bellows unit including a flapper valve therein as taken along line 7—7 in FIG. 8;

FIG. 8 is a top plan view of the modified spring bellows unit of FIG. 7;

FIG. 9 is a side elevational view of the spring bellows unit compressed under a concentrated load;

DESCRIPTION OF THE PREFERRED EMBODIMENTS

Figure 1:
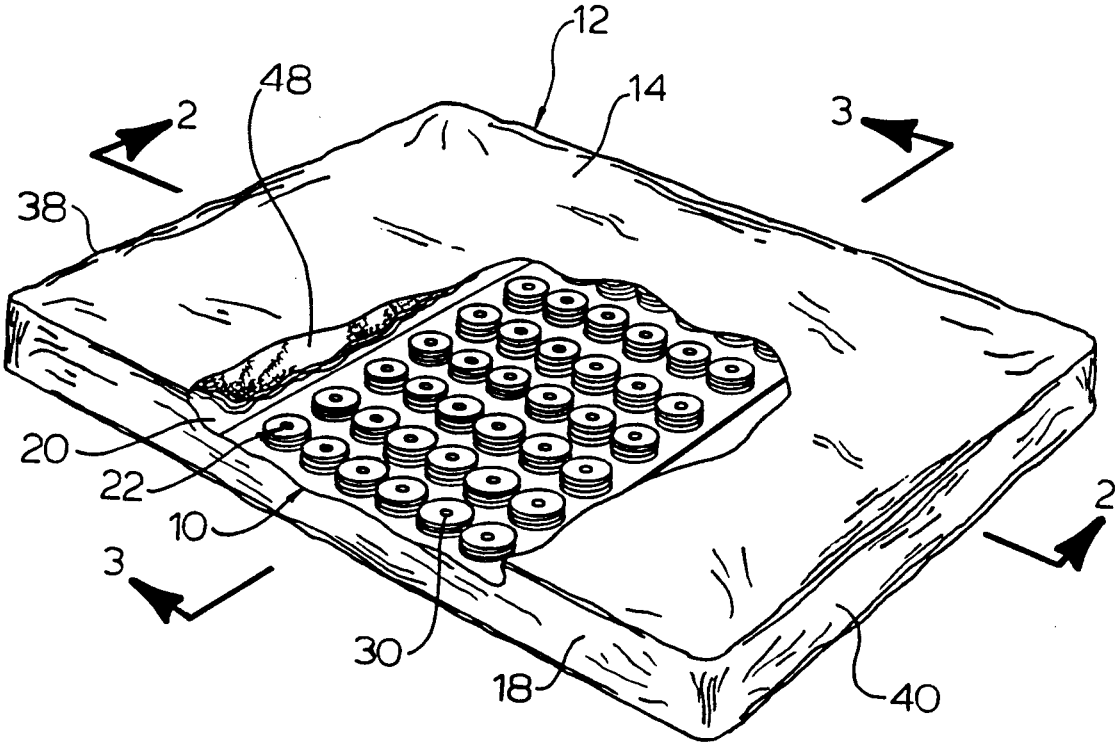
FIG. 1 is a perspective view of a waterbed mattress with a portion cut away to expose the spring insert of the invention.

The spring insert 10 of the present invention is illustrated in FIG. 1 installed within a waterbed mattress 12 which includes a top wall 14, bottom wall 16 and a peripheral sidewall 18, all interconnected to define a fluid tight chamber 20.

Spring insert 10 includes a plurality of open bottomed generally cup-shaped spring bellows units 22, each of which has a top wall 24 and a pleated sidewall 26. The bellows are formed of a relatively stiff plastic. Whereas the pleated sidewalls afford an inherent spring action which resists compression from the normal expanded position of the bellows shown in FIGS. 4 and 5, the bellows are collapsible under a load to a shortened compressed height as illustrated in FIG. 9, wherein the internal volume of the spring bellows unit is substantially reduced. Each unit furthermore has a large bottom opening 28 and a smaller bleeder opening 30 through one wall of the unit. In the preferred embodiment, the single bleeder opening is centrally situated on top wall 24 as shown in FIGS. 1 and 6.

A bottom panel 32 arranges the bellows units relative to one another and supports them in upright relation within the waterbed chamber 20. Bottom panel 32 has a plurality of spaced apart openings 34 registered with respective spring bellows units 22, particularly with the bottom opening 28 thereof. In the preferred embodiment illustrated in the drawings, the spring bellows units have no bottom wall. Rather, the lower peripheral edge of the pleated sidewall is integrally formed with bottom panel 32. Accordingly, each spring bellows unit 32 necessarily engages the panel 32 in registration with an opening 34 therein.

The pleated sidewall 26 preferably comprises a plurality of integral stacked annular pleated wall sections 36 which are alternately inclined so that the angles between adjacent sections may be changed to accommodate vertical expansion and compression of the overall spring bellows unit 22. The pleated wall sections are molded at angles corresponding to the normal expanded position of the bellows unit, as illustrated in FIGS. 4 and 5, so that they are spring biased back to that position once compressive forces are removed from the unit.

Whereas the bottom panel may be of a size to cover the entire bottom wall 16 of a waterbed mattress and may likewise have spring bellows units distributed across substantially the entire longitudinal and transverse extent of the waterbed mattress, the illustrated preferred embodiment shows a bottom panel which spans the transverse extent of the mattress but which covers only a large central portion of the mattress longitudinally. Little performance is sacrificed since most concentrated loads on a waterbed mattress are due to sitting which generally occurs within the longitudinal extent of the bottom panel 32 as shown in FIGS. 1 and 2, the ends of the panel being spaced from the head end 38 and foot end 40 of mattress 12.

The spring bellows units are preferably arranged in relatively closely spaced relation so as to provide support for most of the area above the bottom panel yet not interfere with one another.

An alternate embodiment for the spring bellows unit is illustrated in FIGS. 7 and 8. The single central bleeder opening 30 is replaced by a plurality of circumferentially spaced apart bleeder openings 42 which overlie a flexible circular diaphragm 44 secured at its center to the bellows unit top wall 24 by a suitable and preferably watertight fastener 46 such as a rubber-like rivet, thermo-welding or the like. Compression forces on the bellows unit increase the water pressure within the bellows, thereby effectively sealing the flapper valve 44 against the underside of top wall 24 to close the bleeder openings 42. After a load is removed, expansion of the bellows unit causes water flow in through bleeder openings 42 past the flexible flapper valve 44.

It would be generally undesirable for the user of the waterbed to feel the engagement of the top wall 14 with the bellows units. For this purpose and to somewhat extend the spring action affect of the bellows units to the areas between the bellows units, a filler such as fiber, of polyester or other suitable waterbed filler material, is placed on top of the spring insert 10 as a mechanical insulator from the mattress top wall 14. It is contemplated that other known mechanical insulators could be substituted for the fiber.

In operation, a concentrated load, as indicated by arrow 50 in FIG. 9, is first slightly resisted by compression of the fiber layer 48 and the forcing of fluid from the fiber above the spring bellows unit 22. As the fiber is compressed against the top wall 24 of bellows unit 22, the bellows unit begins to be compressed. Initial compression tends to seal the edge surrounding bottom opening 28 to the mattress bottom wall 16 with the result that fluid flow from the bellows unit is substantially constrained to flow through bleeder opening 30. The inherent spring force of pleated sidewall 26 resists compression and sinking of the mattress top wall 14 further into the mattress at the point of the load 50. When coupled With the hydraulic action of the bellows unit, the spring action affords a smooth cushioned resistance to even quite substantial concentrated loads such as a person's full body weight.

Upon removal of load 50, the spring action of bellows unit 22 causes it to expand back to its normal expanded height as shown in FIGS. 4 and 5. The expansion generates suction forces against mattress bottom wall 16 which securely anchors bottom panel 32 in place within the mattress even without any mechanical fasteners. Water is drawn in through bleeder opening 30 until bellows unit 22 returns to its normal extended height.

The modified bellows unit of FIGS. 8 and 9 operates as described above except that compression of the bellows increases the internal fluid pressure which thereafter closes flapper valve 44 for increased hydraulic resistance to further compression. Extension of the bellows back to its normal height is facilitated, however, by the increased number of bleeder openings 42.

Figure 11:
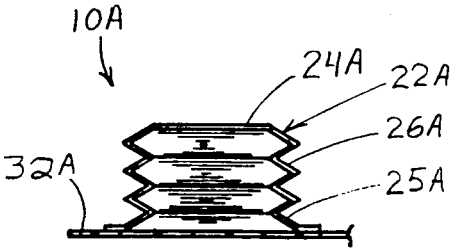
FIG. 11 is a side sectional view of an alternate embodiment of a spring bellows unit.

FIG. 11 illustrates a still further embodiment of a spring insert 10A wherein the bottom panel 32A effectively closes the open bottom end of the spring bellows units 22A. The bellows units may be secured onto the bottom panel 32A by thermal welding, adhesive or any other suitable means. The hydraulic action of spring bellows unit 22A, as compared to the previously described spring bellows units 22, may be altered by eliminating a bleeder opening through top wall 24A and providing one or more bleeder openings 25A through pleated sidewall 26A.

Figure 12:
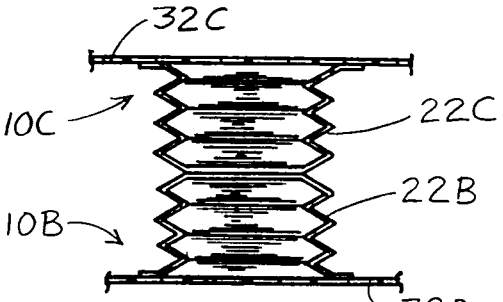
FIG. 12 is a side sectional view of a spring insert including stacked spring bellows units of the type illustrated in FIG. 11.

FIG. 12 illustrates that increased support may be provided within a waterbed mattress by stacking a pair of spring inserts 10A one above the other. They may both be arranged in upright relation as shown in FIG. 11 or, preferably, the uppermost insert 10C is inverted as shown in FIG. 12 to present a top panel 32C. The spring inserts 10B and 10C may be interconnected by thermal welding, adhesives, tape, straps, fasteners, or any suitable means for holding the panels in the desired positional relation to one another.

Figure 13:
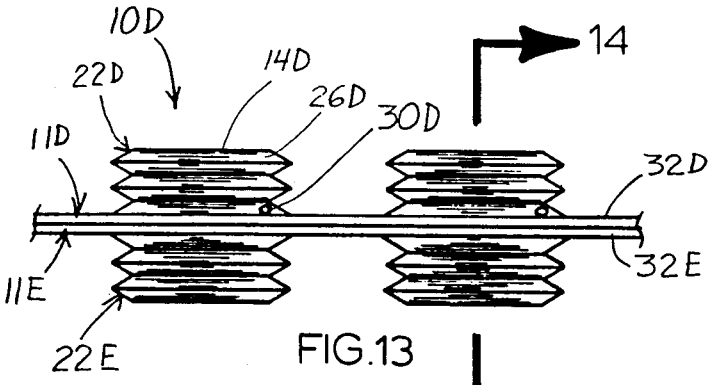
FIG. 13 is a foreshortened side view of an alternate spring insert comprised of stacked upper and lower spring sections.
Figure 14:
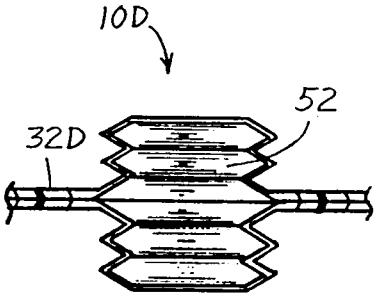
FIG. 14 is a side Sectional view of a joint hydraulic chamber of the spring insert of FIG. 13.

FIG. 13 illustrates a still further spring insert 10D which comprises upper and lower spring sections 11D and 11E. Upper spring section 11D is preferably formed like the previously described spring insert 10 of FIGS. 1-6, except that the normal expanded height of the spring bellows units 22D may be shorter since they will be combined with lower spring bellows units 22E to cooperatively form joint hydraulic chambers 52, as illustrated in FIG. 14. Furthermore, the top spring bellows units 22D may have a closed top wall 14D and one or more bleeder openings 30D through the pleated sidewall 26D.

The lower spring section 11E is illustrated as the mirror image of upper spring section 11D, except that the lower spring bellows units 22E have no bleeder openings formed therein. They simply afford added volume for the joint hydraulic chambers 52 formed by the combined upper and lower spring bellows units 22D and 22E.

Upon compression of the joint hydraulic chambers 52, the upper and lower spring sections 11D and 11E are forced together. Likewise, upon removal of a concentrated load, the spring action of the upper and lower bellows units 22D and 22E creates suction within the joint hydraulic chamber 52 which serves to maintain the upper and lower spring sections 11D and 11E together. Nevertheless, to prevent misalignment of the upper and lower spring sections, it may be desirable to secure the top and bottom panels 32D and 32E together at selected positions by thermal welds, adhesive, fastening clips or any other suitable means.

Figure 15:
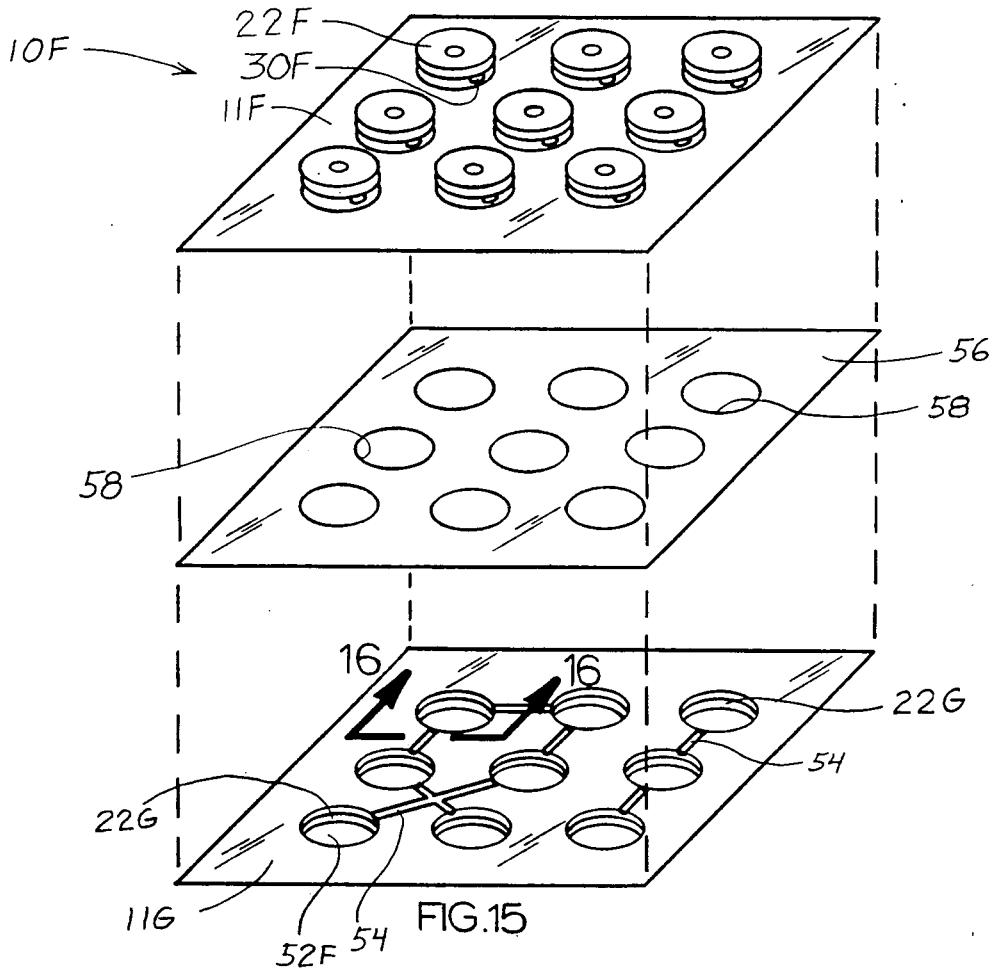
FIG. 15 is an exploded perspective view of an alternate embodiment of a spring insert, including a valve plate between upper and lower spring sections.
Figure 16:
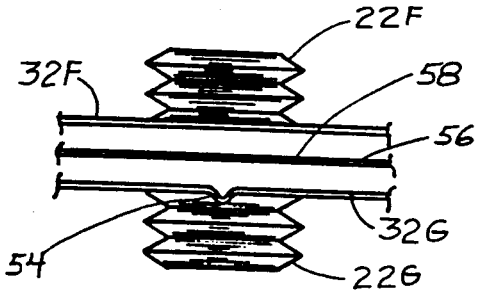
FIG. 16 is a sectional view taken along line 16—16 in FIG. 15.
Figure 17:
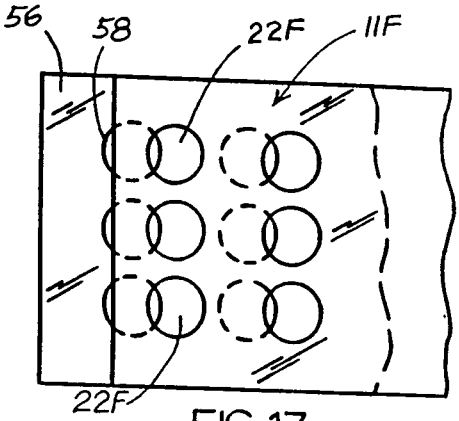
FIG. 17 is a partial top view of the spring insert of FIG. 15 showing the valve plate offset relative to the bellows units.

FIGS. 15-17 illustrate a further embodiment of the invention. Like the embodiment of FIGS. 13 and 14, this spring insert 10F includes upper and lower spring sections 11F and 11G, each including a plurality of respective spring bellows units 22F and 22G with appropriate bleeder openings 30F in the spring bellows units of the upper or lower spring sections.

There are two primary differences between the spring insert 10F of FIG. 15 and the spring insert 10D of FIG. 13. First, the lower spring section 11G in FIG. 15 includes a plurality of channels or troughs 54 formed in the top panel 32G for affording limited fluid communication between selected joint hydraulic chambers 52F. As illustrated in FIG. 15, a single lower spring bellows unit 22G may be connected by one or more channels 54 to one or more lower spring bellows units 22G. Certain lower spring bellows units 22G may be stand alone units unconnected to any other such unit or they may be connected to only one other spring bellows unit 22. It is apparent that the number and arrangement of connecting channels 54 affords many opportunities for varying the support characteristics of the spring insert 10F at various positions thereon.

The channels 54 could alternately be formed as tubular conduits interconnecting the spring bellows units at positions in spaced relation from the top or bottom panels, but the open topped trough-shaped channels 54 are preferred for structural simplicity.

The second difference is the inclusion of valve plate 56. It is slidably interposed between the upper and lower spring sections 11F and 11G for varying the hydraulic action of the spring insert as a function of valve plate position. In the simplified embodiment illustrated, valve plate 56 is provided with valve openings 58 that are registered with and substantially the same size as the open ends of the upper and lower spring bellows units 22F and 22G. By sliding the valve plate 56 from the neutral position of FIG. 15 wherein the valve openings 58 are fully registered with the spring bellows units, to an offset position such as illustrated in FIG. 17, the communication between upper and lower spring bellows units 22F and 22G is restricted for stiffer hydraulic action. Alternately, the valve plate opening 58 could be coordinated with the position of channels 54 or other fluid conduit means to alter the fluid connections between various spring bellows units 22G or between lower spring bellows units 22G and upper spring bellows units 22F, as a function of valve plate position. By varying the size and position of the valve openings 58 and the size, position and nature of fluid flow paths to the various spring bellows units in the upper and lower spring sections, virtually unlimited number of possibilities are afforded for varying the hydraulic action of the spring insert 10F in response to valve plate position.

It is contemplated that the position of the valve plate may be adjustable by the user of the waterbed perhaps by manual manipulation of the valve plate upon pressing inwardly on the flexible sides of a waterbed mattress. Alternately, the valve plate position could be fixed in the factory prior to final assembly of the mattress or an electrical or hydraulic control switch could be provided for actuating an electric or hydraulic motor to precisely position the valve plate at a selected position corresponding to a desired hydraulic action for the spring insert.

Figure 19:
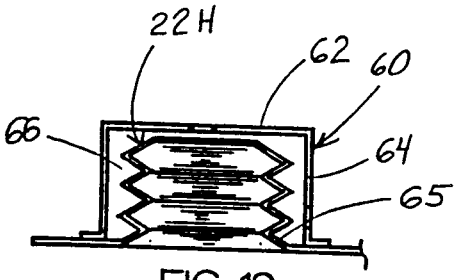
FIG. 19 is an enlarged side sectional view of a spring bellows unit enclosed within a flexible cover.
Figure 18:
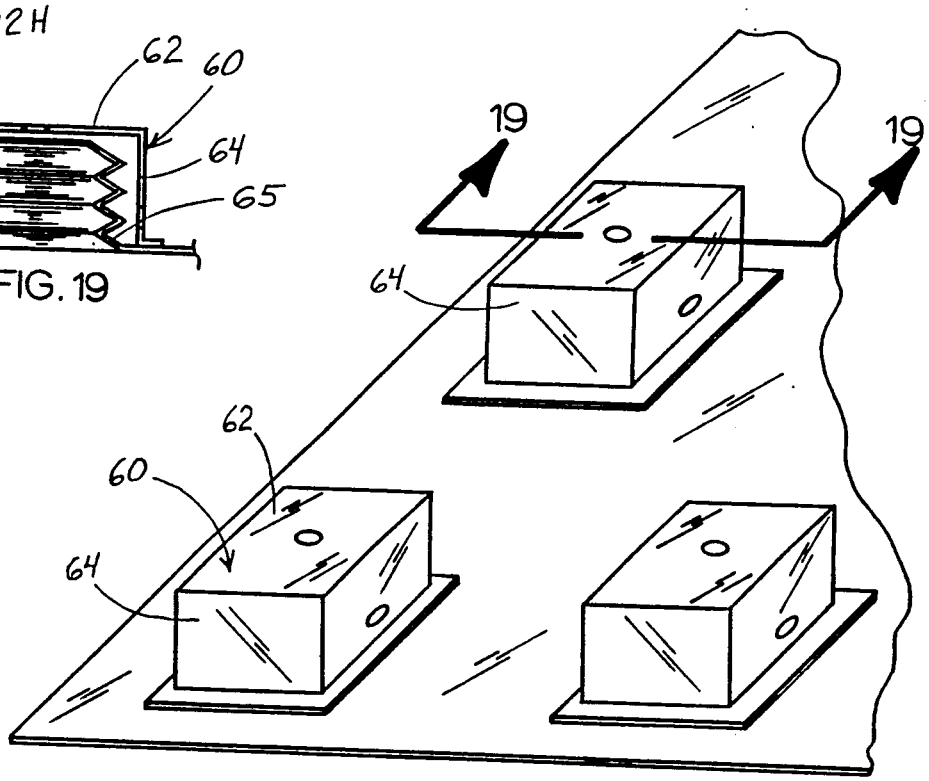
FIG. 18 is a partial perspective view of a plurality of flexible covers for positioning and supporting spring bellows units therein.

FIGS. 18 and 19 illustrate a still further embodiment wherein a spring bellows unit 22H is confined within a generally inverted cup-shaped cover 60 formed of a flexible sheet material. Cover 60 has a top wall 62 and a peripheral sidewall 64 which, upon sealing of the lower edge of sidewall 64 to the surface on which the bellows unit 22H is supported, define a secondary hydraulic chamber 66 between the bellows unit 22H and cover 60.

As shown in FIG. 19, the covers 60 may be used in conjunction with a spring insert 10 of the type illustrated in FIGS. 1–6, in which case the spring bellows units 22 may be formed of substantially lighter and less expensive material, since the hydraulic action of such units will be enhanced by the secondary hydraulic chambers 66. The spring bellows unit 22 simply needs sufficient spring force to expand back to a normal expanded height after removal of a load. This eliminates the need for any flotation means on the cover chambers 60.

Alternately, the covers 60 may be sealed directly to the mattress bottom wall 16 or they may be sealed to a separate flexible sheet, preferably of the same material as the covers, so as to form a unitary insert for a waterbed mattress. The number and size of bleeder openings through one or more walls of the cover 60 may be selected to achieve the desired hydraulic action.

Figure 10:
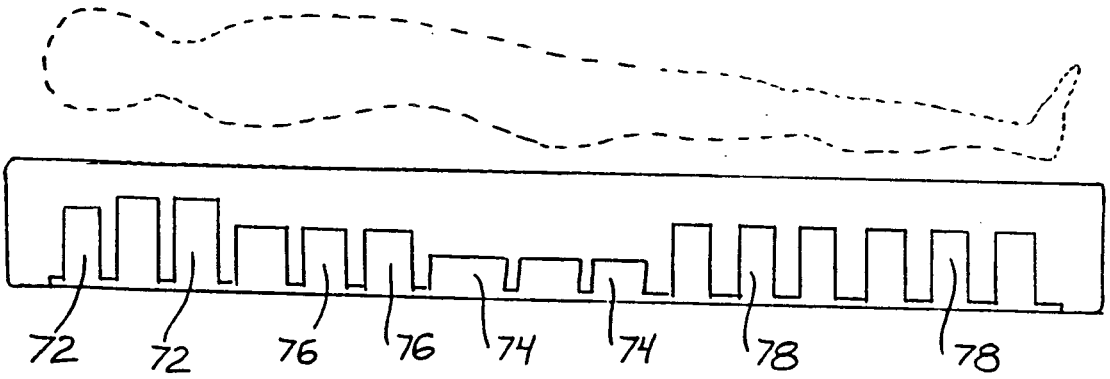
FIG. 10 is a side sectional view of an alternate embodiment of a waterbed mattress with spring inserts designed to vary the support characteristics at different positions on the mattress top surface.

An important feature of the invention is that it not only affords additional support to prevent a concentrated load from bottoming out on the waterbed mattress, but it also enables variances in the degree of support afforded at different positions on a waterbed mattress. For example, support characteristics may be varied to accommodate a large individual on one side of the mattress and a small individual on the other side of the mattress. Likewise, from head to toe, the degree of support may be varied to accommodate different body parts. FIG. 10 diagrammatically illustrates a spring insert 70 having relatively taller spring bellows units 72 for supporting the back of the neck of an individual and relatively shorter and wider spring bellows units 74 for supporting the buttocks. The various spring bellows units 76 which support the back of a sleeper may have an intermediate height and width compared to bellows units 72 and 74. Chambers 76 for supporting the sleepers legs may likewise be relatively tall.

Whereas the invention has been described in connection with preferred embodiments thereof, it is understood that many modifications, substitutions and additions may be made which are within the intended broad scope of the appended claims. For example, the bellows units could be interconnected by structure other than the integral bottom panel 32 or separate bellows units may be confined by baffle means for proper placement within the mattress. Furthermore, the pleated sidewalls need not have the frustoconical shaped wall sections as illustrated but rather may have a sine wave shape in cross section or any other suitable shape which produces the desired spring action. Alternate spring bellows units could take the form of smooth sided telescoping cup sections with a compression spring therein and appropriate bleeder openings to enable expansion and compression.

Thus there has been shown and described an improved spring insert and waterbed which accomplish at least all of the stated objects.

I claim:

1. In a waterbed mattress including a top wall, bottom wall and a peripheral sidewall, all interconnected to define a fluid tight chamber, the improvement comprising, a plurality of spring bellows units within said chamber, each unit having at least one end wall and a peripheral sidewall and each unit being collapsible from a normal expanded height to a shortened compressed height wherein the internal volume of the unit is substantially reduced, spring means for spring biasing each bellows unit to the normal expanded height thereof, and each bellows unit further including a bleeder opening in one wall thereof, and means for supporting said bellows units in upright relation within said chamber whereby downward force exerted on a bellows units through the mattress top wall tends to collapse the unit against the spring action of the sidewall thereof and against the hydraulic action thereof whereby fluid flow from said unit is generally constrained.

2. The waterbed mattress of claim 1 wherein said spring means comprises a pleated shape and resilient material of said peripheral sidewall thereby forming a pleated sidewall.

3. The waterbed mattress of claim 2 wherein said pleated sidewall comprises a plurality of stacked annular pleated wall sections.

4. The waterbed mattress of claim 2 wherein the pleated sidewall of one or more said spring bellows units have different spring rates than the pleated sidewall of other of said spring bellows units.

5. The waterbed mattress of claim 2 wherein each bellows unit has a generally inverted cup shape with an open bottom, said means for supporting said bellows units comprising a panel connected to and substantially closing the open bottom of said bellows units.

6. The waterbed mattress of claim 5 wherein said bleeder opening is formed in the pleated sidewall of said bellows unit.

7. The Waterbed mattress of claim 2 wherein said means for supporting said bellows units comprises a plurality of inverted cup shaped covers formed of a flexible sheet material, each cover being sealed to the surface supporting and said bellows units thereby to define a secondary hydraulic chamber between said bellows unit and cover.

8. The waterbed mattress of claim 7 wherein said cover has a top wall and peripheral sidewall.

9. The waterbed mattress of claim 8 wherein said cover has a bleeder opening through one wall thereof.

10. The waterbed mattress of claim 7 wherein said support surface comprises said bottom wall of the mattress.

11. The waterbed mattress of claim 7 wherein said support surface comprises a flexible bottom sheet connected to and closing the bottom end of said covers.

12. The waterbed mattress of claim 7 wherein the height of said cover is generally equal to the normal expanded height of the respective bellows unit supported therein.

13. The waterbed mattress of claim 7 wherein the width of said cover is generally equal to the width of the respective bellows unit supported therein.

14. The waterbed mattress of claim 1 wherein said means for supporting said bellows units comprises a panel having a plurality of openings therein, each bellows unit engaging said panel in registration with an opening in said panel.

15. The waterbed mattress of claim 14 wherein each bellows unit has a bottom edge secured to said panel whereby said panel engages the mattress bottom wall.

16. The waterbed mattress of claim 15 wherein said panel is free of any mechanical attachment to the mattress bottom wall.

17. The waterbed mattress of claim 15 further comprising means for attaching said panel to the mattress bottom wall.

18. The waterbed mattress of claim 14 wherein said panels and bellows units are integrally formed of plastic.

19. The waterbed mattress of claim 1 wherein said bleeder opening is formed in an end wall of the bellows unit.

20. The waterbed mattress of claim 1 further comprising a mechanical insulator overlying said bellows units.

21. The waterbed mattress of claim 20 wherein said mechanical insulator comprises a layer of fiber.

22. The waterbed mattress of claim 1 wherein said means for supporting said bellows unit is operative to arrange said bellows unit in a nonuniform distribution over said bottom wall thereby to impart different support for different areas of the mattress top wall.

23. The waterbed mattress of claim 22 wherein said mattress extends longitudinally from a head end to a toe end thereof and transversely between opposite sides and said bellows units being arranged in positions substantially across the transverse extent of said mattress.

24. The waterbed mattress of claim 23 wherein said bellows units are arranged in an area generally centered longitudinally in said mattress and spaced from both ends thereof.

25. The waterbed mattress of claim 24 wherein spring bellows units positioned for supporting the neck of a sleeper are taller than spring bellows units positioned for supporting the buttocks of a user.

26. The waterbed mattress of claim 1 wherein some of said spring bellows units have a greater transverse cross sectional area than other of said spring bellows units thereby to vary the area of support afforded by said spring bellows units.

27. The waterbed mattress of claim 1 wherein the normal expanded heights of said spring bellows units differ in relation to the position of the respective spring bellows units on said bottom wall.

28. The waterbed mattress of claim 1 wherein some of said spring bellows units have different force/deflection characteristics than other of said spring bellows units thereby to vary the degree of support at different positions on the waterbed mattress.

29. The waterbed mattress of claim 28 wherein some of said spring bellows units have more bleeder openings than other of said spring bellows units.

30. The waterbed mattress of claim 28 wherein some of said spring bellows units have a greater combined total area of bleeder openings than other of said spring bellows units.

31. The waterbed mattress of claim 1 further comprising one way valve means operatively associated with said bleeder opening to close said bleeder opening in response to compression of the bellows unit.

32. The waterbed mattress of claim 31 wherein said one way valve means comprises a flapper valve on the underside of the top wall of the bellows unit.

33. The waterbed mattress of claim 1 further comprising valve means operatively associated with at least some of said spring bellows units for adjusting the hydraulic action of said units.

* * * * *